United States Patent [19]

Douez

[11] Patent Number: 4,726,076

[45] Date of Patent: Feb. 23, 1988

[54] CHILDS GARMENT

[76] Inventor: Francoise Douez, 1, Rue du Surmelin, 75020 Paris, France

[21] Appl. No.: 786,084

[22] Filed: Oct. 10, 1985

[51] Int. Cl.[4] ..... A41B 13/06; A41D 11/00

[52] U.S. Cl. ..... 2/69; 2/80; 2/243 B

[58] Field of Search ..... 2/69, 114, DIG. 7, DIG. 6, 2/243 B, 70, 80

[56] References Cited

U.S. PATENT DOCUMENTS

| | | | |
|---|---|---|---|
| 1,202,332 | 10/1916 | Tschirgi | 2/243 B |
| 1,372,189 | 3/1921 | Pollock | 2/243 B |
| 1,475,892 | 11/1923 | Sohn | 2/69 |
| 3,568,213 | 3/1971 | Mason | 2/114 |
| 4,258,440 | 3/1981 | McGowan | 2/114 |
| 4,304,006 | 12/1981 | Swart | 2/114 |
| 4,382,303 | 5/1983 | Lunt | 2/DIG. 7 |

FOREIGN PATENT DOCUMENTS

| | | | |
|---|---|---|---|
| 1480026 | 3/1965 | Fed. Rep. of Germany | . |
| 1460026 | 2/1969 | Fed. Rep. of Germany | . |
| 1577493 | 6/1969 | France | . |
| 197665 | 3/1920 | United Kingdom | 2/243 B |

*Primary Examiner*—Werner H. Schroeder
*Attorney, Agent, or Firm*—Larson and Taylor

[57] ABSTRACT

The aim of the invention is a garment characterized by the fact that it comprises a single piece of material which before dressing the baby is a flat surface in substantially the shape of a cross having a longitudinal and a transversal axis (DD and AA) in which the four projecting parts (**1+2, 3+3*bis*, 4+4*bis*, 5**) have substantially quadrilateral forms, and in which:

- two of these quadrilaterals (**3+3*bis*, 4+4*bis***) form the lateral parts;
- the upper part (1+2), after dressing, forms the front of the garment;
- the lower part (5), after dressing, forms the back of the garment;
- a system of fasteners (7, 8, 9, 10) equipping said upper part (1 and 2) and the lower part so that the lower part (5) may be attached to the upper part (1 and 2), once the upper part (1 and 2) has been folded down (over the shoulders) to cover the front of the baby's body.

25 Claims, 12 Drawing Figures

CHILDS GARMENT

The invention relates to a single garment, destined particularly for children and infants, and more particularly for new born babies, which does not require slipping said cloth over the head and slipping the arms into said cloth.

The invention also relates to a single garment, likely to be worn by adults.

There are many clothes for infants and babies, but they do not meet the specific needs of the child in early childhood and more particularly do not meet the needs of the new born baby.

The clothes which are known so far are the following ones:

baby's sleeved vest (or sleeved undershirt) in cotton or cotton with a raised nap which is worn next to the skin of the baby, but this garment necessitates to slip the arms of the baby into it, which is uneasy; the fastening of the garment in the back is not very trustworthy and requires lifting the baby's back to try to fasten the vest;

vest (or undershirt) which eliminates the disadvantage of the fastening in the back, but has the disadvantage of having to be slipped over the head, which gives way to, of course, an uncomfortable situation for the new born (who is particularly sensitive to uncomfortable situations created by slipping a garment over his head) and he starts crying;

woollen baby's sleeved vest or backtie kimono ("cache-coeur") the fastening of which is in the back and is constituted either by a string which is knotted, at the neck of the baby or in a crossed shape which can be fastened on the chest of the baby ("cache-coeur"); in both cases, it is necessary to slip the arms into the sleeves, which have to be slipped over the sleeves of the sleeved vest in cotton or cotton with a raised nap, or in thread, and to turn the child around to fasten the garment either in his back or on his chest;

breeches, trousers or pants in cotton or wool, are stepped into and cover the diapers or the diaper pants; in both cases, it is necessary to lift the pelvis of the baby, to put the garmet under the buttocks of the baby;

socks or booties in wool or in thread;

"gigoteuse" or one piece footed pyjamas or footed stretch overalls in knitted cotton, knitted towelling or wool, which are clothes covering the body of the baby from his head to his foot; these clothes present the drawback of having to slip the arms and legs into them and must, most of the time, be fastened at the back of the baby, which makes it necessary to turn the baby around.

Moreover, the subsequent layers of these different clothes do not always give the desired thermal effect.

They have the drawback of a repetitive manipulation, unpleasant for the baby and for the parent who is fearful of dressing the baby, particularly when the aim is to create a pleasurable relationship between the baby and the parents and also to facilitate tending to the baby's needs.

There is so far, no garment of a new conception avoiding manipulation of the baby and which combines several textile layers of different properties, necessary and sufficient for the warmth required for the baby.

The applicant provides a garment which, in the great simplification of the dressing, has a large advantage by canceling the fear of the parents and thus bringing ease into the new relationship with the new born baby.

The importance of this element is proved today and pointed out by the whole pediatric department, in France and abroad.

One of the aspects of the invention is to provide a single garment, which does not require being slipped over the head and which does not require to slip the arms and legs into this garment and which is likely to be well adapted for adults and more particularly for children.

One of the aspects of the invention is to provide a single garment, which meets more particularly the needs of the children, particularly babies, and more especially new born babies.

Another of the aspects of the invention is to provide a single garment, with no seam in the back, which avoids the superposition of different elements such as sleeved vests, undershirts, vests, etc. which are used currently to dress new born babies.

Another aspect of the invention is to provide a single garment which avoids the unpleasant manipulation for the new born babies, since it cancels slipping over the head, and slipping the arms into the garment and does not require to turn the baby around to dress him.

Another of the aspects of the invention is to provide a single garment which gives the warmth necessary for new born babies, according to the seasons.

Another of the aspects of the invention is to provide a single garment, avoiding all the drawbacks of manipulation such as slipping over the head and turning the baby around, yet enabling to change easily the diapers of the baby.

Another aspect of the invention is to provide a single garment which enables the baby to move freely, whereas keeping the warmth he needs.

Another apsect of the invention is to provide a garment which dispels the fear of the parents, when dressing the new born baby and which is easy to use for dressing children.

More particularly, the object of the invention is a baby garment characterized by the fact that it comprises a single piece of material, which before dressing the baby is a flat surface in substantially the shape of a cross, having a longitudinal axis and a transversal axis in which the four projecting parts have substantially quadrilateral forms, particularly trapezoidal or rectangular, of which three of their sides are free and the fourth adjoins the rest of the material, and in which;

two of these quadilaterals extending from each other and crossed by the transversal axis—thus forming the lateral parts—are identical, and the crease of these lateral parts, approximately along the transversal axis or along an axis substantially parallel to the transversal axis and hereafter designated "shoulder crease axis", allows the upper edges respectively of these two lateral parts to be brought together with their respective lower borders to form the sleeves, the upper and lower borders respectively of each of the lateral parts being equipped with a system of fasteners allowing the upper and lower edges of each of the lateral parts to be held together;

the upper part which after dressing forms the front of the garment, crossed by the longitudinal axis is split substantially along the longitudinal axis or along an axis substantially parallel to the longitudinal axis, from the upper edge of the upper part to the centre of the cross, which is a substantially circular hole whose circumference roughly corresponds to the size of the baby's neck, this upper part is thus formed of two elements whose dimension is such that when the two elements are folded or pulled down (over the shoulders) along the axis of the shoulder crease defined above, the baby's body is covered over a length going from his neck to at least his abdomen and across the entire width of the front of his body, each of these two upper elements being equipped along their respective edge of the aforesaid split, with a system of fasteners permitting them to be attached together when folded over the front of the baby's body;

the lower part, which after dressing, forms the back of the garment extending from the upper (frontal) part and crossed by the longitudinal axis has a length at least equal to the distance between the neck and the abdomen of the baby and a width substantially corresponding to the width of the baby's back;

a system of fasteners equipping said upper part so that the lower part may be attached to the upper part, once the upper part has been folded down (over the shoulders) to cover the front of the baby's body.

The terms "single piece of material" is defined as a surface of material liable to comprise for instance seams and cuttings, but comprising no parts liable to be slipped over the head or into which one slips the arms or the legs of the child, such as the pre-shaped sleeves, pre-shaped legs, pre-shaped pants or pre-shaped vest.

The terms "substantially the shape of a cross" are defined as a surface, the figure of which is a geometrical shape comprising four projecting parts, or convex lobes, in which a longitudinal axis can be defined, along which the baby is laid for dressing and a transversal axis along which the arms of the babies can be put during the dressing up procedure.

But the terms "substantially the shape of a "cross" must not be limited to the shape of a cross, such as usually defined, but also encompassing the geometrical shapes, the projecting parts of which do not present sharp angles, but all the intersections between the different edges are rounded, the projecting parts forming thus lobes or petals.

At the intersection between the transversal axis and the longitudinal axis, the centre of the cross comprises a hole which is substantially circular on which the head of the baby is placed during dressing.

A substantially parellel direction with respect to the longitudinal (or transversal) axis is hereafter defined as a direction, the generating vector of which presents an angle with respect to the longitudinal (or transversal) axis lower than 45°.

When the baby has been laid along the longidutinal axis, the baby's head is on the hole (centre of the cross), the baby's back is situated on the lower lobe which will hereafter be called "lower part".

The lobe situated above the baby's head is called "upper part".

The two lobes on which the arms of the baby are placed whilst dressing are called "lateral parts".

The aim of these lateral parts is to form sleeves and they are identical as to their shape and their surface.

These lateral parts have substantially quadrilateral shapes, particularly trapezoidal or rectangular and present three of their sides (or edges) free whereas the fourth side is engaged in the rest of the piece of material.

The three free sides of these lateral parts are linear but can be curved or present one or several enlargements or cuttings.

The two sides of these lateral parts which are substantially parallel with respect to the transversal axis, can advangtageously comprise enlargements, whereas the side of these lateral parts which is substantially parallel with respect to the longitudinal axis is preferably curved.

The transversal axis of these above defined lateral parts corresponds preferably to the place, where the shoulder line is to be found for dressing the baby.

The upper edge or side of these lateral parts is folded over along the shoulder line, also designed as the "shoulder crease axis", to bring the upper edge (or side) of each of these lateral parts on to the lower edge (or side) and thus to form the sleeves.

These sleeves can be short or long according to the size of these lateral parts.

The lower and upper edges according to the transversal axis of each of the lateral parts are equipped with a system of fasteners to keep the sleeve closed.

The lateral parts may or may not comprise seams.

The seam advantageously marks the shoulder line as above defined.

The upper part has also a quadrilateral shape, particularly trapezoidal or rectangular.

The upper part is split on all its length from the upper border, i.e. from the upper edge parallel to the longidutinal axis down to the circular hole which thus delimitates the two upper elements.

Each of the upper elements comrpises three free edges or sides, two of which are substantially parallel to the longitudinal axis and the other is substantially parallel to the transversal axis.

One of the free sides of the lower elements substantially parallel to the longitudinal axis corresponds to the slip of the upper part.

The fourth side of each of the upper elements is engaged in the rest of the piece of material.

The free sides of each of the upper elements can be linear, but can also be curved or comprise enlargements and cuttings.

Advantageously, the free side which is substantially parallel to the transversal axis of one of the upper elements is bigger than the corresponding free side of the other element, so that when the two upper elements are folded over along the shoulder axis, after placing the baby as mentioned above, these two elements covering the front of the baby at least down to his abdomen can be fastened together.

The aim of this is to efficiently fasten the part of the garment on the front of the baby.

The size of the free side which is substantially parallel to the transversal axis of each of the upper elements is equal to about half the size of the width of the front of the baby's body.

A system of fasteners is fixed on the respective sides of the upper elements on the side of the split.

A system of fasteners can also be advantageously located on the free boarders which do not mark the split, but which are substantially parallel to the longitudinal axis of each of the upper elements, in order to fasten the upper elements to the lower part which constitutes the back of the garment.

A system of fasteners can be also fixed on the respective borders which are substantially parallel to the transversal axis of the upper elements, to possibly fasten the upper elements to an element comprised in the lower part of the garment.

The lower part comprises a longitudinal axis along which the back of the baby is laid. This lower part comprises two free sides, which are substantially parallel to the longitudinal axis, a third side which can be free or which can be engaged in the rest of the piece of the garment according to the embodiment of the bottom of the garment.

The distance between the two free sides of this lower part corresponds substantially to the width of the back of the baby.

The free sides can be linear or curved.

They can advantageously comprise cuttings or enlarged parts.

The embodiment of this garment enables to place the baby on the completely unfolded garment and to dress the baby by folding the different mentioned parts to make the sleeves and the front of the garment over him, to fasten them together without slipping the garment over the head and without the arms being slipped into the garments and without needing to turn the baby around.

BRIEF DESCRIPTION OF THE DRAWINGS

For a better understanding of the invention as well as other objects and further features thereof, reference is made to the following detailed description to be read in conjunction with the accompanying drawings, wherein.

DETAILED DESCRIPTION OF THE PREFERRED EMBODIMENT

Figure 1:
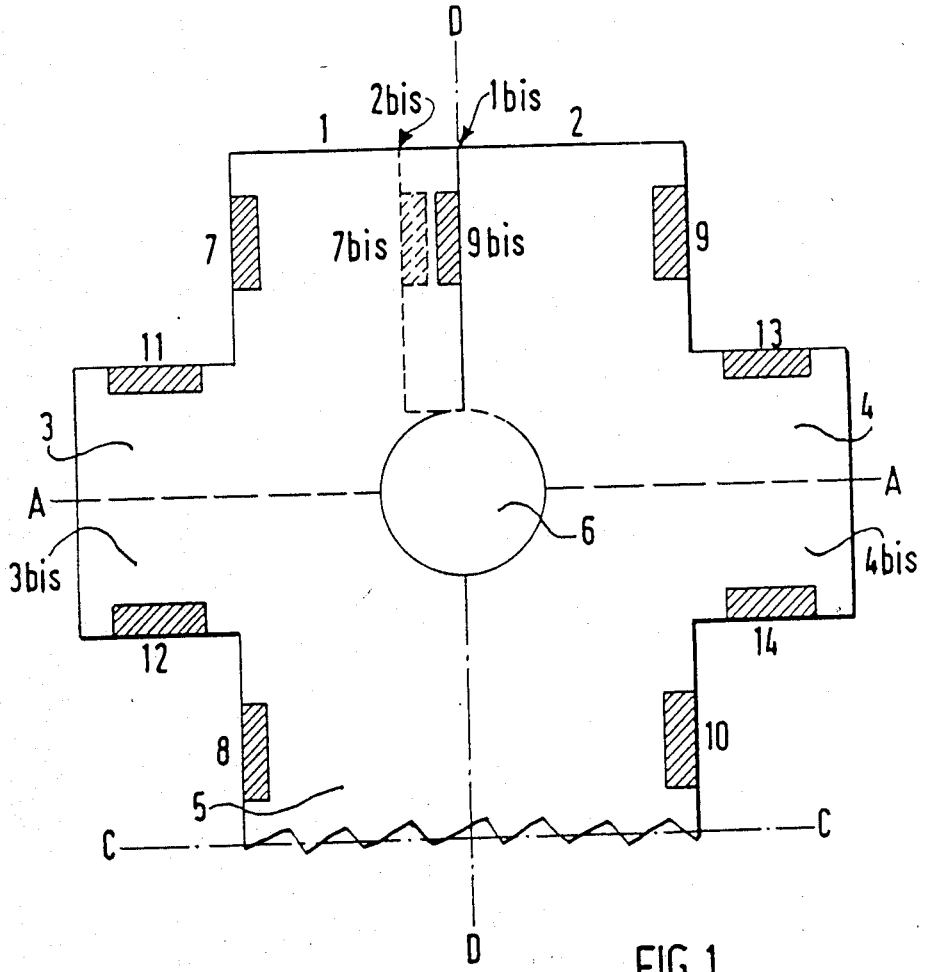
FIG. 1 shows a garment of the invention completely unfolded on a plane and comprising fastening means.

According to a preferred embodiment, the lateral parts are such that the free side, which is substantially parallel to the longitudinal axis, is equipped with a strap of material which is closed, or liable to be closed on itself, independently from the lateral part according to a circular shape in a perpendicular plane with respect to the plane on which the garment is unfolded.

The circular strap enables to surround the wrist or the wrist and forearm of the baby; thus, whe dressing up the baby, after putting him on the completely unfolded garment along the longitudinal axis of the garment, the two circular straps are slipped over the hands or the hands are slipped into the straps, so that the straps surround the wrists of the baby, which makes dressing the baby easier, mostly when he moves his arms.

The width of the material straps must not be too thin, so that they are solid enough to resist the efforts of the baby's wrist, and their maximum width must be such that when slipping the wrist or the wrist and forearm into the strap, this movement requires only a minimum of effort.

The circular straps are advantageously the width of the baby's wrists, but their width can vary between about 0.3 cm to about 4 cm.

The material of these circular straps can be identical with respect to that of the rest of the garment. But is can be advantageously constituted of a stretch material which is appropriate for the skin, the morphology and the comfort of the baby. As appropriate materials, one may resort to ribbed material, the ribs of which provide for a certain elasticity.

According to a preferred embodiment, all the projecting parts of the garment, when it is completely unfolded are advantageously such that the intersections between the free sides are not at acute angles, but are rounded or present an aesthetical cutting.

Preferably, the intersection between the different free sides of each of the projecting parts is rounded, so that each of the projecting parts of the garment has for instance the shape of a petal, the embodiment of which is nevertheless adapted for the dressing by folding over the different parts as it has been mentioned above.

According to a preferred embodiment, the garment of the invention is constituted of a single piece of material which before dressing the baby is a flat surface, substantially in the shape of a cross, having a longitudinal axis and a transversal axis in which the four projecting parts have approximately quadrilateral forms, particularly trapezoidal or rectangular, of which three of their sides are free and the fourth adjoins the rest of the material, and in which:

two of these quadrilaterals extending from each other and crossed by the transversal axis—thus forming the lateral parts—are identical and the crease of these lateral parts approximately along the transversal axis, or along an axis approximately parallel to the transversal axis and hereafter designated "shoulder crease axis", allows the upper edges respectively of these two lateral parts to be brought together with their respective lower borders to form the sleeves, the upper and lower borders respectively of each of the lateral parts being equipped with a system of asteners allowing the upper and lower edges of each of the lateral parts to be attached together;

the upper part which after dressing forms the front of the garment, crossed by the longitudinal axis, is split approximately along the longitudinal axis or along an axis approximately parallel to the longitudinal axis, from the upper edge of the upper part to the centre of the cross, which is an approximate circular hole whose circumference roughly corresponds to the size of the baby's neck, this upper part is thus formed of two elements whose dimensions is such that when the two elements are folded or pulled down (over the shoulders) along the axis of the shoulder crease defined above, the baby's body is covered over a length going from his neck to at least his abdomen and across the entire width of the front of his body, each of these two upper elements being equipped along their respective edge of the aforesaid split, with a system of fasteners permitting them to be attached together when folded over the front of the baby's body;

the lower part, which after dressing, forms the back of the garment, extending from the upper part and crossed by the longitudinal axis, has a length varying substantially from the baby's length (measured from neck to feet) of about twice the baby's length (measured from neck to feet), and a width substantially corresponding to the width of the baby's back, said lower part is able to be folded up along an axis approximately parallel to the transversal axis, situated at a distance from the centre of the piece of the material equal to around the distance from the neck to the baby's feet, this axis substantially parallel to the transversal axis being hereafter designated "axis of the foot crease", the element of the lower part thus folded upward from the feet having a length less than or equal to the distance from the feet to the neck;

a system of fasteners equipping the lower part so that the lower part may be attached to the upper part when the upper and lower parts are both folded over to cover the front of the baby's body;

and a system of fasteners so that the element of the lower part folded up over the front of the baby's body may be joined to the corresponding element of the lower part which covers the baby's back.

In this embodiment, the two legs of the baby are not separated.

According to another embodiment, the garment according to the invention is so that the lower part is such equipped with a longitudinal split arranged symmetrically relative to the axis of the foot crease, and the half-length of which is equal to approximately the distance between the feet and the crotch of the baby permitting after having folded the said lower part up along the axis of the foot crase to form accomodations for the legs and feet of the baby, the edges of this split are quipped with a system of fasteners allowing the parts of the edges which are symmetrical relative to the foot crease to be held together.

In this embodiment, the two legs of the baby are individually covered. The width of the accomodation for the feet and legs of the baby can be chosen as desired.

According to another embodiment, the garment according to the invention is such that the lower part includes pants, the leg ends of which are open or closed (depending on whether the baby's feet are covered or not) and whose lower elements of the sides of the pant legs from the foot or from the ankle to around the calf are pre-attached to each other, whereas the upper elements of the sides of the pant legs, from the calf to the upper edge of the pants are equipped with a system of fasteners to attach together the frontal and dorsal parts of the pant legs and so that the upper part of the pants can be equipped with a system of fasteners to attach together the top of the pants and the upper parts of the garment also equipped with a system of the garment, when it is folded down over the baby.

In this embodiment, the lower part of the pants is pre-attached, for instance sewn, on a length which goes from about the end of the feet to about the ankle or on a length going from about the ankle up to about the calf, whereas the respective edges of each of the trouser legs, from about the calf to the upper edge of the pants, i.e. up to the abdomen for the external edges and up to the crotch for the lower edges, are free before dressing the baby. These edges are fixed to each other to gather the dorsal and frontal part of each of the trouser legs by a system of fasteners.

Advantageously, the lower edges of the dorsal and frontal part of the legs of the pants, going from the foot or the ankle up to the crotch are pre-attached, for instance sewn.

In this case, for dressing the baby, the feet are slipped into the garment and it is possible to put clean diapers on the baby without taking off the pants, whilst the upper part of the garment remains in its place.

In this embodiment, the length of the legs of the pants measured along the external sides, can vary from the calf to the abdomen and particularly vary from the knee of the baby up to his abdomen, or from any point of the thigh of the baby up to the baby's abdomen.

According to a preferred embodiment, the garment of the invention has the shape practically of a symmetrical cross relative at the same time to its transversal axis and longitudinal axis in which:

the upper part is such that each of the two upper elements has a length at most equal to the length of the child, measured from neck to feet and including along a length at most equal to around the length of the baby's leg and at least around a quarter of the length of the baby's leg, an approximately rectangular element which is set back relative to the split, the lower part has a length at most equal to the baby's length measured from neck to feet, this lower part includes on a length at most equal to the length of the baby's leg and at least around a quarter of the length of the baby's leg two substantially rectangular, identical elements, and identical with the two substantially rectangular elements of the upper part and, for one thing, separated from each other by a split, and for another, recessed relative to the longitudinal axis, and in which after the folding down from the shoulder crease of the upper part, each of the substantially rectangular elements of the upper part covers each of the substantially rectangular elements of the lower part to form pants whose leg length varies according to the length of the various said rectangular parts.

According to another preferred embodiment of the invention the garment according to the invention is such that below the two lateral parts of the cross are two additional lateral parts, which will also be hereafter designated by the name "tabs", located substantially perpendicularly to the longitudinal axis and substantially parallel to the transversal axis, located along the sides of the lower part, which are substantially parallel to the longitudinal axis, between the lower edge of the lateral parts which form the sleeves and the place of the lower part, which corresponds to the bottom of the baby's back.

These two parts of material constitute additional lateral parts which can be folded over each other, along a substantially parallel direction to the transversal axis.

These two additional lateral parts are located so that they advantageously cross on the baby's stomach and comprise a system of fasteners enabling them to be attached together.

These two additional lateral parts are advantageously equipped with a system of fasteners enabling them to be attached on the front of the baby's garment.

These two lateral parts are advantageously shaped like parallelpipedic retangular or trapezoidal straps, the ends of which, which cross each other, can be curved and comprise one or more enlargements or cuttings.

According to a preferred embodiment, the garment according to the invention is such that the two elements of the upper part have sizes from about 11 cm to about 20 cm, in particular about 18 cm, parallel to the transversal axis from about 22 cm to about 40 cm, in particular about 32 cm, parallel to the split, the length of the split is about 22 cm to about 40 cm, in particular 32 cm, the lateral parts are about 22 cm to about 38 cm, in particular 32 cm, parallel to the transversal axis, from about 20 cm to about 35 cm, in particular 30 cm, parallel to the longitudinal axis, the lower part is from about 40 cm to about 70 cm, in particular about 65 cm, parallel to the longitudinal axis, from about 22 cm to about 38 cm, in particular about 32 cm, parallel to the transversal axis, the straps are from about 10 cm to about 15 cm, parallel to the transversal axis and about 10 cm to about 20 cm, parallel to the longitudinal axis, the circumference of the hole for the passage of the neck is about 30 cm. These measures vary of course according to the age and the size of the child.

The garment according to the invention can also have dimensions appropriate to the morphology of any adult, child or baby and in particular appropriate to a new born baby up to a 6 year old child.

The different edges, borders, or sides above defined, can be linear, but can also be curved or comprise enlargements or cuttings.

These enlargements or cuttings are advantageously used to attach thereon systems of fasteners.

The systems of fasteners used can be the ones conventionally utilized in the ready made garment, particularly for children.

They are advantageously chosen among buttons, press-studs, zips, straps, ribbons, adhesives, strips commercialized under the name Velcro strips.

Velcro in various forms will advantageously be resorted to.

Velcro strips will advantageously be resorted to, attached at one or several points of the parts to be held together and preferably attached along the whole length of the sides of the parts to be held together.

Advantageously, the intersection between the free side, substantially parallel to the longitudinal axis and opposed to the split of the upper element above defined, and the free side, substantially parallel to the transversal axis of a lateral part, has a convex shape so that when the lateral parts are folded up along the shoulder crease axis, on the one hand to form the sleeves and on the other hand when the upper part is folded up to form the front of the garment, there is a piece of material which can be introduced under the baby's armpit in order to have a perfect closing of the sleeve and of the part of the garment.

The convex shape which is above defined advantageously presents a rounded shape.

Of course, the dimensions which are given relative to the different parts do not take into account the enlarged parts, cuttings or straps of material, which are possibly added for the comfortable wearing of the garment, for the making up and the asethetical aspect of the garment, or to improve the location of the system of fasteners.

The material which is used for making said garment comprises advantageously two layers of different material, and generally of different nature:

a layer of material which will be put in contact with the skin of the baby and which presents nonallergenic properties and which is appropriate for the skin of children;

a layer of material, which perferably presents thermal properties, situated on the material which is directly in contact with the skin of the baby and is to bring sufficient warmth for the child.

As appropriate materials for babies' skin, one may cite cotton, cotton veil, cotton knit, towel knot, linen, flannel, lined material or silk.

As materials presenting thermal properties, one may cite particularly clorofibre, which presents tribo-electrical properties.

The garment can also comprise a layer of material, or of synthetic or artificial material, which can also play an aesthetical part. This layer of material can replace the layer of material presenting thermal properties or can advantageously constitute a third layer situated on the layer presenting the thermal properties. This layer can, for instance, be constituted of cotton, cotton veil, cotton knit, towel, towel knit, wool, polyester, acrylic, polyamide, polyamide 6—6, polyamide aramid, amterial with raised naps, viscose, acetate, triacetate, modal, this list being not limitative.

According to the season, one resorts to the thickness and to the appropriate material of the layers of the material to be used.

This garment according to the invention can also be of non woven material, which enables to throw away the garment after use; thus the garment according to the invention is a disposable garment.

This garment according to the invention can also be such that the internal material, which is directly in contact with the baby's skin, is removable from the rest of the garment so that it can be changed when necessary.

This internal material which is directly in contact with the baby's skin, and which can be removed from therest of the garment will advantageously be non woven.

According to an advantageous embodiment of the invention, the garment according to the invention can also comprise a hood which can be removed or not from the rest of the garment, preferably attached to the circular hole which has been above defined or in a place located next to the shoulder crease axis, said hood being destined for covering the child's (or adult's) head.

The aim of the invention is also to provide any garment for children which has the above mentioned characteristics in which, when the garment is completely unfolded, the child is placed on his stomach to be dressed up, the upper part (which, in the above defined embodiments, is the front of the garment) corresponds to the back of the garment and the lower part (which, in the above defined embodiments, is the back of the garment) corresponds to the front of the garment.

According to a preferred embodiment of the invention, the garment comprises a single piece of material which before dressing the baby is a flat surface in substantially the shape of a cross, having a longitudinal axis and a transversal axis in which the four projecting parts have substantially quadrilateral forms, particularly trapezoidal or rectangular, of which three of their sides are free and the fourth adjoins the rest of the material, and in which:

two of these quadrilaterals extending from each other and crossed by the transversal axis—thus forming the lateral parts—are identical and the crease of these lateral parts approximately along the transversal axis or along an axis substantially parallel to the transversal axis and hereafter designated "shoulder crease axis", allows the upper edges respectively of these two lateral parts to be brought together with their respective lower borders to form the sleeves, the upper and lower borders respectively of each of the lateral parts being equipped with a system of fasteners allowing the upper and lower edges of each of the lateral parts to be held together;

the upper part which after dressing forms the back of the garment, crossed by the longitudinal axis, is split substantially along the longitudinal axis or along an axis substantially parallel to the longitudinal axis, from the upper edge of the upper part to the centre of the cross, which is a substantially circular hole whose circumference roughly corresponds to the size of the baby's neck, this upper part is thus formed of two elements whose dimensions are such that when the two elements are folded or pulled down (over the shoulders) along the axis of the shoulder crease defined above, the baby's body is covered over a length going from his neck to at least the base of his back and across the entire width of the back of his body, each of these two upper elements being equipped along their respective edges of the aforesaid split, with a system of fasteners permitting them to be attached together when folded over the back of the baby's body;

the lower part, which after dressing, forms the front of the garment extending from the upper (dorsal) part and crossed by the longitudinal axis, has a length at least equal to the distance between the neck and the base of the baby's back and a width substantially corresponding to the width of the baby's front;

a system of fasteners equipping said upper part and the lower part so that the lower part may be attached to the upper part, once the upper part has been folded down (over the shoulders) to cover the back of the baby's body.

According to a preferred embodiment of the invention, the garment is constituted of a single piece of material which before dressing the baby, is a flat surface substantially in the shape of a cross, having a longitudinal axis and a transversal axis in which the four projecting parts have approximately quadrilateral forms, particularly trapezoidal or retangular, of which three of their sides are free and the fourth adjoins the rest of the material, and in which:

two of these quadrilaters extending from each other and crossed by the transversal axis—thus forming the lateral parts—are identical and the crease of these lateral parts approximately along the transversal axis, or along an axis approximately parallel to the transversal axis and hereafter designated "shoulder crease axis", allows the upper edges respectively of these two lateral parts to be brought together with their respective lower borders to form the sleeves, the upper and lower borders respectively of each of the lateral parts being equipped with a system of fasteners allowing the upper and lower edges of each of the lateral parts to be attached together;

the upper part which after dressing forms the back of the garment, crossed by the longitudinal axis is split approximately along the longitudinal axis or along an axis approximate parallel to the longitudinal axis, from the upper edge of the upper part to the centre of the cross, which is an approximately circular hole whose circumference roughly corresponds to the size of the baby's neck, this upper part is thus formed of two elements whose dimension is such that when the two elements are folded or pulled down (over the shoulders) along the axis of the shoulder crease defined above, the baby's body is covered over a length going from his neck to at least the base of his back and across the entire width of the back of his body, each of these two upper elements being equipped along their respective edge of the aforesaid split, with a system of fasteners permitting them to be attached together when folded over the back of the baby's body;

the lower part, which after dressing, forms the front of the garment, extending from the upper part and crossed by the longitudinal axis, has a length varying substantially from the baby's length (measured from neck to feet) of about twice the baby's length (measured from neck to feet), and a width substantially corresponding to the width of the baby's front, said lower part is able to be folded up along an axis approximately parallel to the transversal axis, situated at a distance from the centre of the piece of the material equal to around the distance from the neck to the baby's feet, this axis substantially parallel to the transversal axis being hereafter designated "axis of the foot crease", the element of the lower part thus folded upwards from the feet having a length less than or equal to the distance from the feet to the neck;

a system of fasteners equipping the lower part and the upper part so that the lower parts may be attached to the upper part when the upper and lower parts are both folded over to cover the back of the baby's body;

and a system of fasteners equipping the lower part and the upper part so that the lower parts may be attached to the upper part when the upper and lower parts are both folded over the cover the back of the baby's body;

and a system of fasteners equipping the element of the lower part folded over the back and the lower part, so that the lower part folded up over the back of the baby's body may be joined to the corresponding element of the lower part which covers the front of the baby.

The invention will be better understood by means of the drawings, which, because of their schematic nature have only an illustrative nature which is given as a guide for a better understanding of the invention, but are absolutely not a limitation.

FIG. 1 represents a garment according to the invention, completely unfolded on a plane where :

the D—D axis represents the longitudinal axis, the A—A axis represents the transversal axis, the C—C line separates the chest from the legs and the garment can have a length going from the hole 6 down to the C—C line or can have any shape under the C—C line;

1 and 2 form the two upper elements of the upper part, and are separated by the split, the edges of which are separated by 1*bis* and 2*bis*, the dotted line 2*bis* meaning that the upper element 2 is larger than 1, so that the chest of the baby can be covered;

the upper elements 1 and 2 are folded up along the shoulder crease on the lower part 5;

3, 3*bis* on the one hand and 4, 4*bis* on the other hand represent the lateral parts, 3 and 4 being over the shoulder crease axis substantially parallel to A—A and, 4 and 4*bis* being below the shoulder crease axis substantially parallel to A—A;

3, after it has been folded over 3*bis*, forms the sleeve, which is maintained by means of the fasteners 11 and 12, whereas the fasteners 13 and 14 close the sleeve which is obtained by folding part 4 over part 4*bis;*

6 corresponds to the hole for the baby's head;

the fasteners 7 and 8, on the one hand, 9 and 10 on the other hand, are used to maintain the upper elements 1 and 2 on the lower part 5;

the fasteners **7*bis* and 9*bis* are used to attach together the two upper elements 1 and 2 when they have been folded up along the shoulder crease axis on to part 5**.

For language commodity, the upper part is designated by 1+2, the two lateral parts are respectively designated by **3+3*bis* and 4+4*bis*, the lower parts is designated by 5**.

Figure 2:
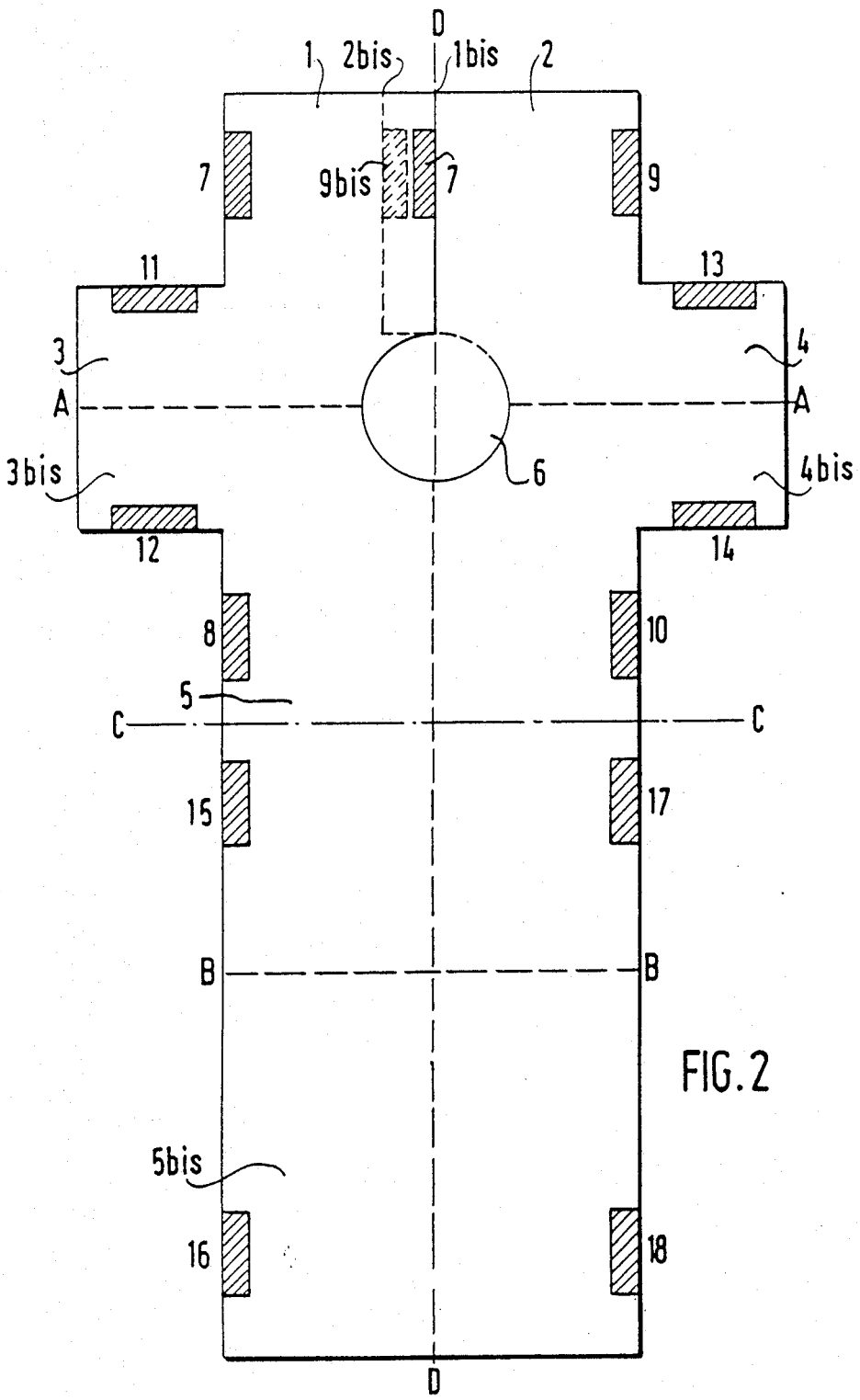
FIG. 2 illustrates a garment of the invention showing the bottom of the lower part.

FIG. 2 represents a garment according to the invention, completely unfolded on a plane where:

the references 1 to 14 have the meanings mentioned in FIG. 1;

and the B—B axis is the foot crease axis as above defined;

**5*bis* represents the bottom of the lower part, which is liable to be folded according to the B—B axis on the front of the baby and to be attached to the back of the garment by means of the fasteners 15 and 16, on the one hand, 17 and 18** on the other hand.

In this embodiment, it is possible in a first step firstly to fold the elements 1 and 2 on to part 5 along the shoulder crease axis, then in a second step, to fold up the part **5*bis* on to the part 5** along the foot crease axis or to carry out both steps, the other way around the system of fasteners being then accordingly adapted.

Figure 3:
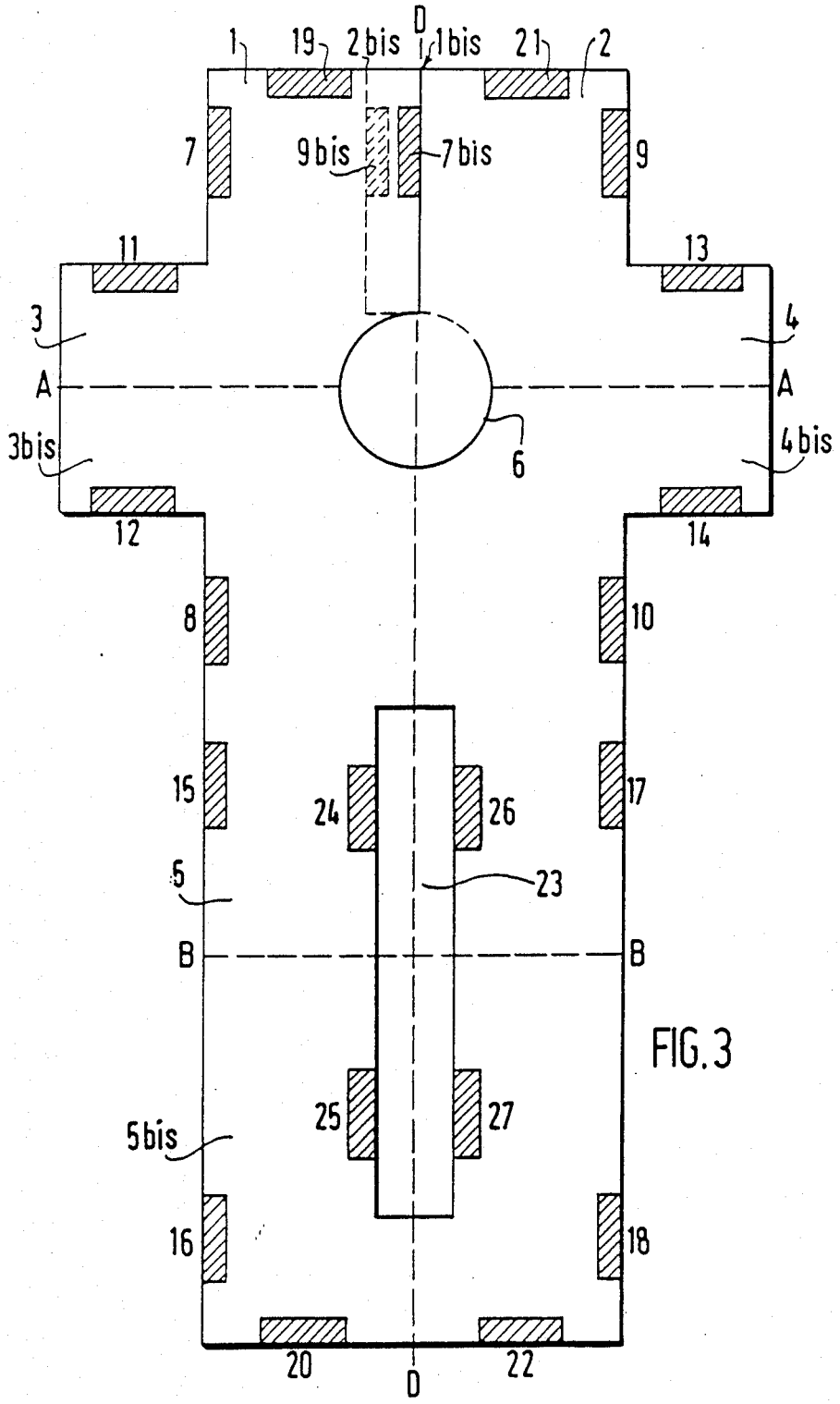
FIG. 3 shows a garment of the invention wherein the bottom of the lower part comprises a split, which after folding up leads to the obtention of individual accomodation for the legs.

FIG. 3 represents a garment according to the invention, completely unfolded on a plane and in which the references 1 to 18 have the above mentioned meaning in FIGS. 1 and 2 and in which 23 represents a symmetrical split with respect to the foot crease axis, so that after folding up part **5*bis* along 13 onto part 5, two individual accomodations are obtained for the feet and legs of the baby, by means of the system of fasteners 19, 21 on the one hand and 20, 22 on the other hand, and respectively attached to the upper edge of the upper part, and to the lower edge of the lower part, the frontal and dorsal parts of each of these accommodations being attached together by means of fasteners 24 and 25, on the one hand, 26 and 27**, on the other hand.

Figure 4:
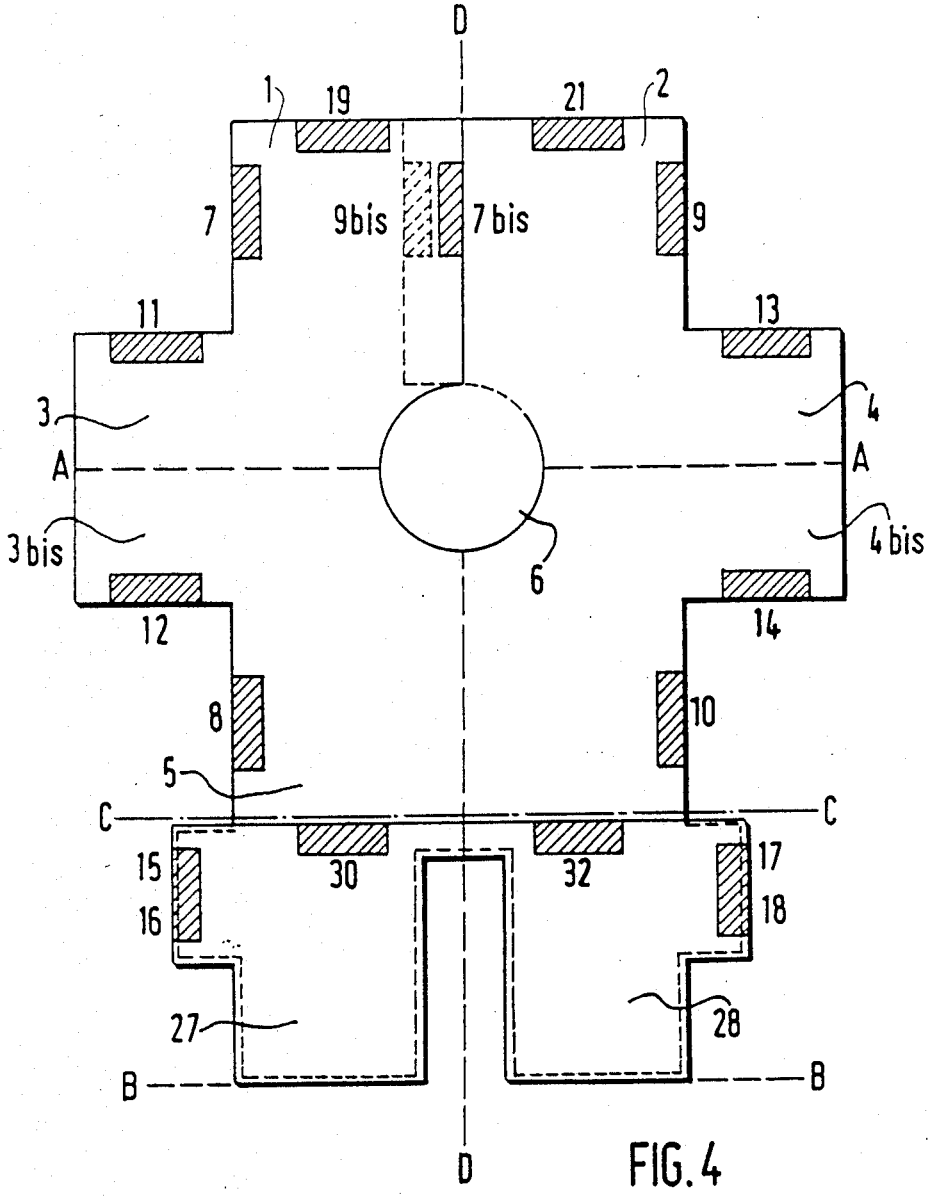
FIG. 4 shows a garment of the invention comprising pants with pre-attached legs.

FIG. 4 represents a garment according to the invention in which the part which is situated below the C—C axis has been described in the preceeding figures and in which the part between the C—C axis and the B—B axis is shaped like pants. The legs of the pants 27 to 28 are pre-attached up to about the calf and the fasteners 17 and 18 on the one hand, 15 and 16 on the other hand are used to attach the frontal upper part and the dorsal upper part of each of the legs of the pants.

The pants are attached to the upper elements 1 and 2 by means of fasteners 16 and 30 on the one hand, 21 and 32, on the other hand.

Figure 5:
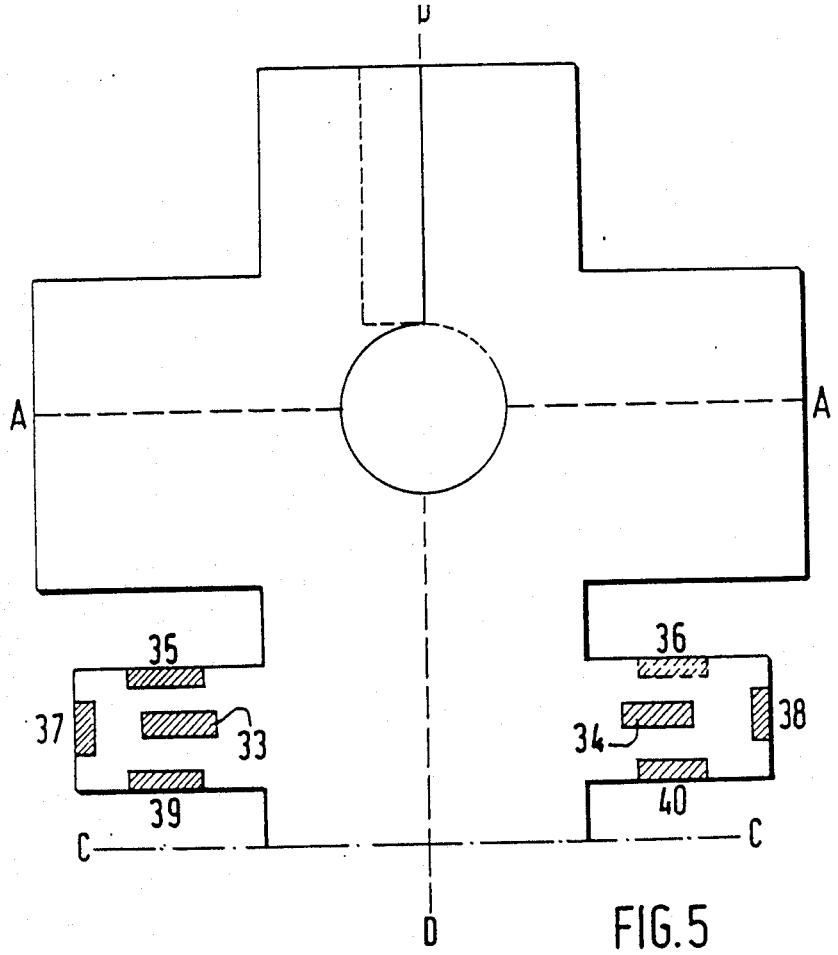
FIG. 5 illustrates the detail of the lateral parts situated below the parts forming the sleeves.

FIG. 5 represents more particularly the additional lateral parts which are situated under the lateral parts which form the sleeves.

These additional lateral parts which form the sleeves, folded on to each other along the longitudinal axis, cross each other on the baby's abdomen and are kept attached by means of a system of fasteners for instance 33, 34 or 35, 36 or 37, 38 or 39, 40 or a combination of these systems.

Figure 7:
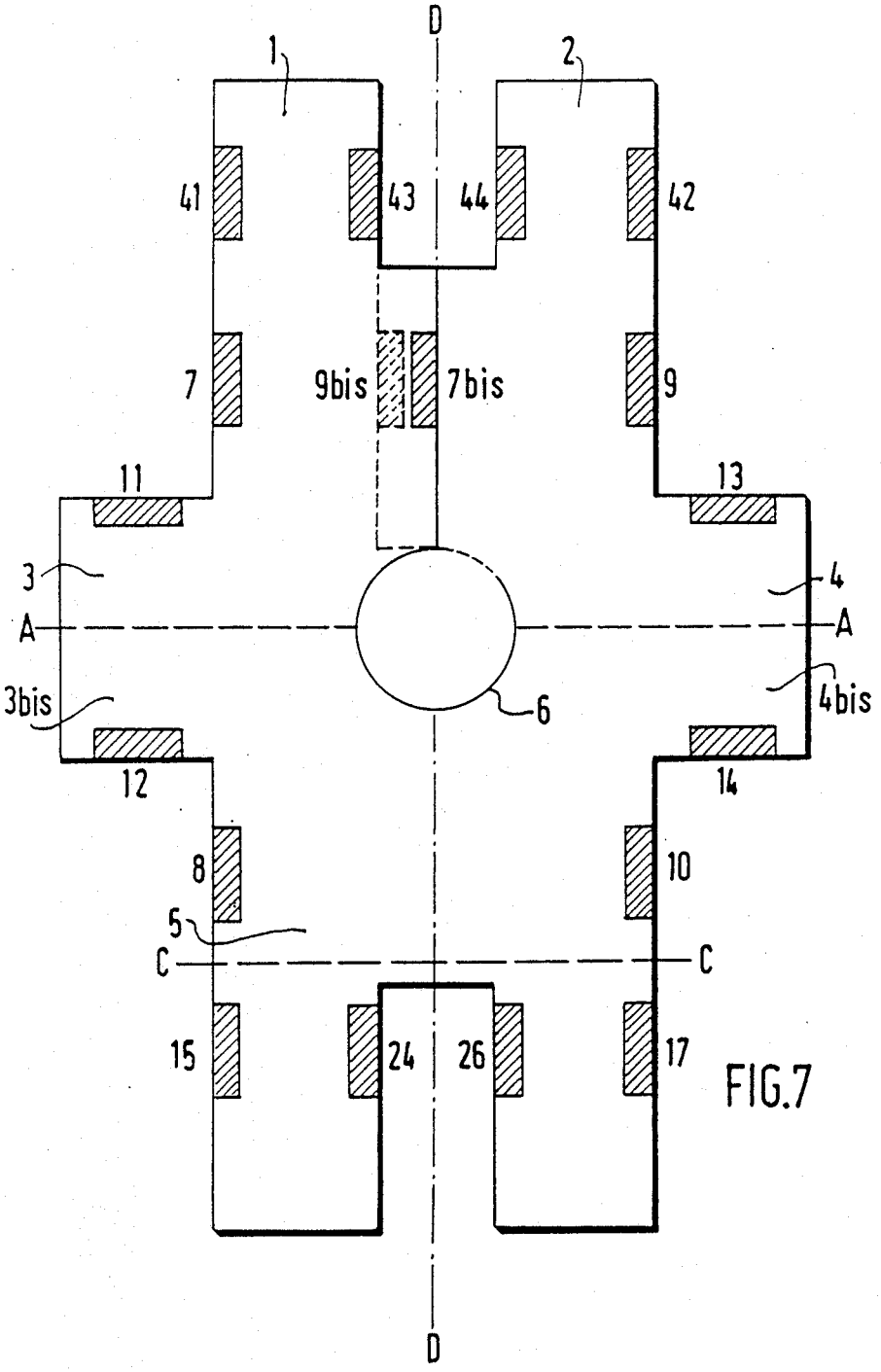
FIG. 7 shows a garment wherein the upper part and the lower part are symmetrical with respect to the shoulder axis.

FIG. 7 is a garment according to the invention which is completely unfolded on a plane 5, the said garment is symmetrical on the one hand with respect to the A—A transversal axis and on the other hand with respect to the D—D longitudinal axis, in which the references 1 to 14 have the meanings given for FIGS. 1, 2, 3 and 4 and in which the upper part is such that each of the upper elements 1 and 2 has a length which is equal at most to the length of the baby, measured from neck to feet and comprise, on a length which is equal to about at most the length of the baby's leg and at least about a quarter of the length of the baby's leg, an element which is substantially rectangular, recessed with respect to the split and in which the lower part has a length at most equal to the length of the baby, measured from neck to feet, the said lower part comprises a length which is at most equal to the length of the baby's leg and at least equal to about a quarter of the length of the baby's leg, two elements which are substantially rectangular, which are identical to each other and identical to the elements which are substantailly rectangular on the upper part and on the one hand separated from each other by a split, and on the other hand recessd with respect to the longitudinal axis and in which after folding along the shoulder crease axis of the upper part, each of the elements which are substantially rectangular on the upper part cover each of the substantially rectangular elements of the lower parts to form pants the leg length of which vary according to the length of the said rectangular parts.

On the one hand, 15 and 41 and on the other hand 17 and 42 represent the system of fasteners, which enables to gather the external sides of the lower and upper rectangular parts, and on the one hand 24 and 43 and on the other hand 26 and 44 enable to gather the internal sides of the lower and upper rectangular parts.

Figure 6:
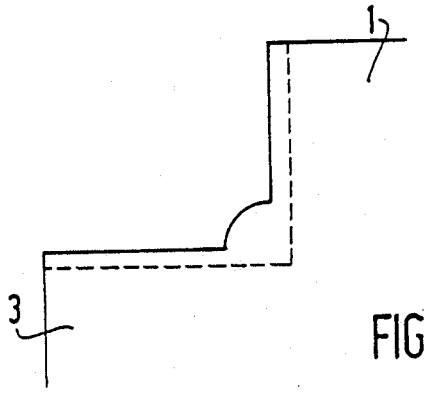
FIG. 6 shows the enlargement which can be put under the baby's armpit.

FIG. 6 schematically represents the intersection of the free side of one of the upper elements opposed to the split, and of the free side of the lateral part 3. This intersection presents an enlargement which can be put under the baby's armpit to obtain the complete fastening of the garment.

Figure 8:
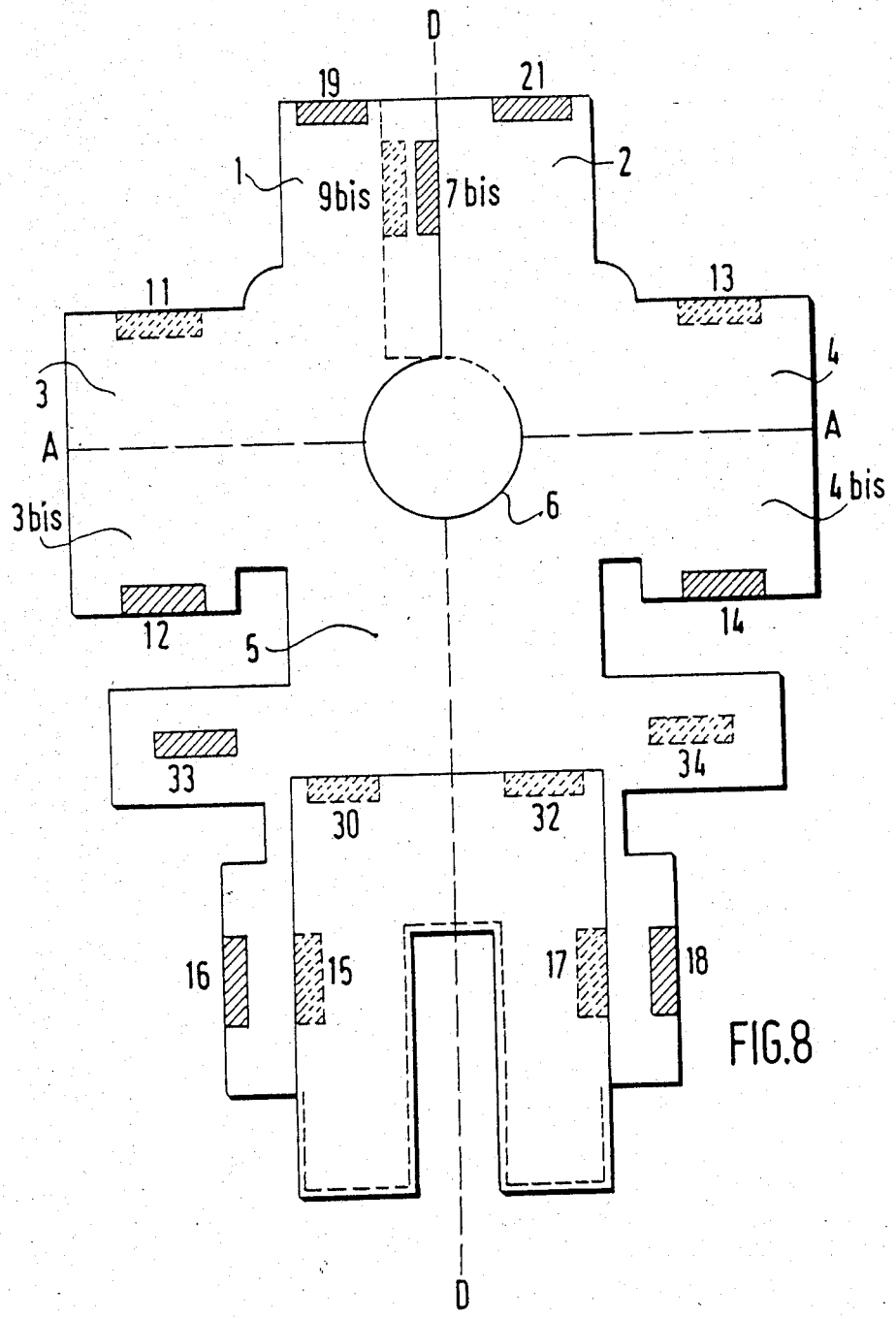
FIG. 8 illustrates a garment comprising parts with pre-attached legs and lateral parts under the parts forming the sleeves.

FIG. 8 represents a garment according to the invention, in which the references, 1, 2, 3, **3*bis*, 4, 4*bis*, 5, 6, 7*bis*, 9*bis*, 11, 12, 13 and 14 have the meaning as mentioned in the previous figures comprising additional lateral parts, which can be attached to each other, after being folded over the baby's abdomen by means of the system of fasteners 33 and 34; the lower part of the garment is constituted by pants, the legs of which are pre-attached on their internal sides and are pre-attached up to about the baby's ankle, on their external side, and the external sides of which from the ankle up to the upper edge of the pants are free; the respective frontal and dorsal parts of each of these legs can be attached by means of systems of fasteners 15, 16 on the one hand 17 and 18 on the other hand. It is possible to notice the cutting of the material on which the fasteners 16 and 18** are attached.

The upper elements 1 and 2, after having been folded on to the pants, are maintained attached to the pants by means of the fasteners 19, 30 on the one hand and 21, 32 on the other hand.

It is to be noted that the additional lateral parts are in this case sufficient to maintain the upper elements 1 and 2 with respect to the part 5 of the back, but it is also possible to foresee a system of fasteners 7, 8, 9 and 10 as it has been mentioned in the figures below.

Figure 9:
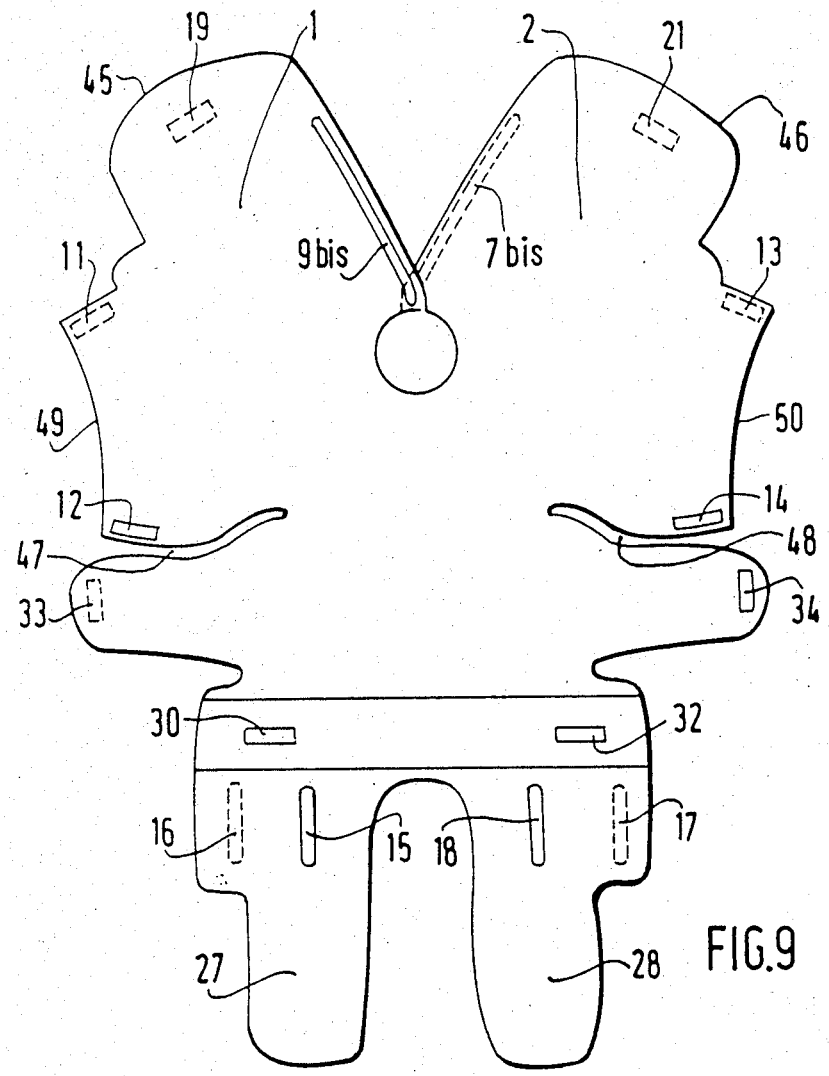
FIG. 9 shows a garment with rounded sides and edges.

FIG. 9 represents a garment according to the invention in which the references 1, 2 **7*bis*, 9*bis*, 11, 12, 13, 14, 15, 16, 17, 18, 19, 21, 27, 28, 30, 32, 33, 34 have the meaning of FIG. 4, and in which the free sides of the upper part (edges 45, 46) are rounded, the lower edges of the lateral parts (edges 47 and 48) are rounded and the edges which are substantially parallel with respect to the longitudinal axis (edges 49 and 50**) are curved.

EXAMPLE 1

Figure 10:
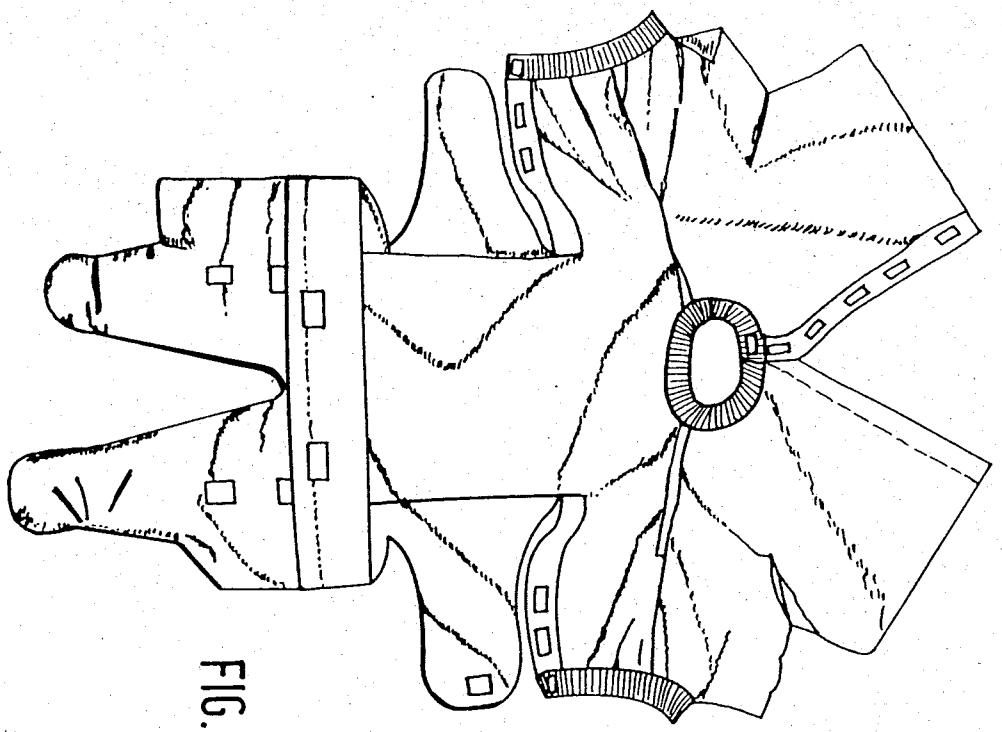
FIG. 10 shows a garment of the invention before dressing.

A garment according to the invention such as represented, before dressing, has been made on FIG. 10.

The different squares represent where the Velcro can be found.

Figure 11:
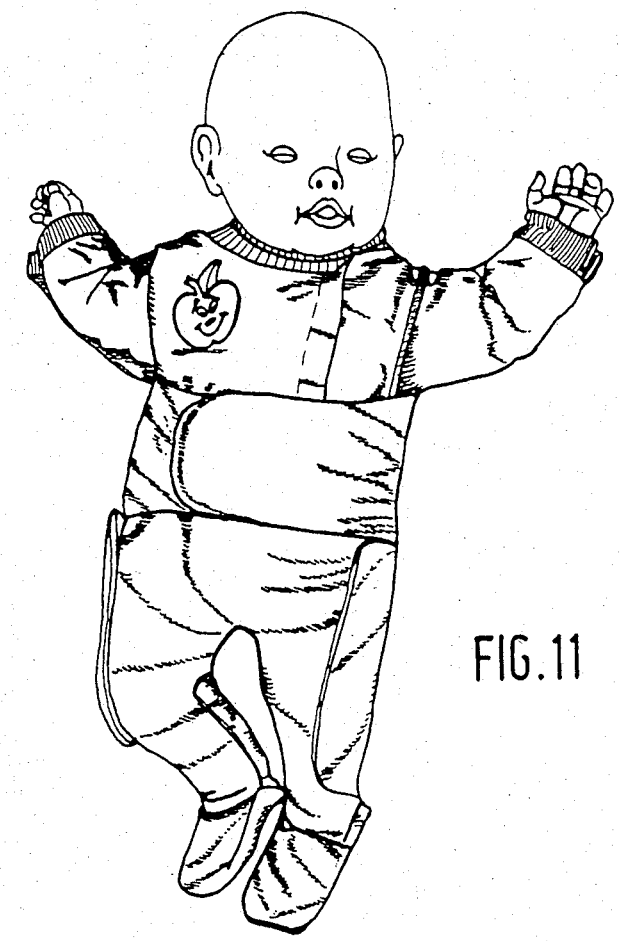
FIG. 11 shows dressing of the baby with the garment of FIG. 10.

FIG. 11 represents the dressing of the baby according to the invention. The baby's head is put on the hole and the pants are put on the baby, then the different elements are folded to form the front and the sleeves.

Figure 12:
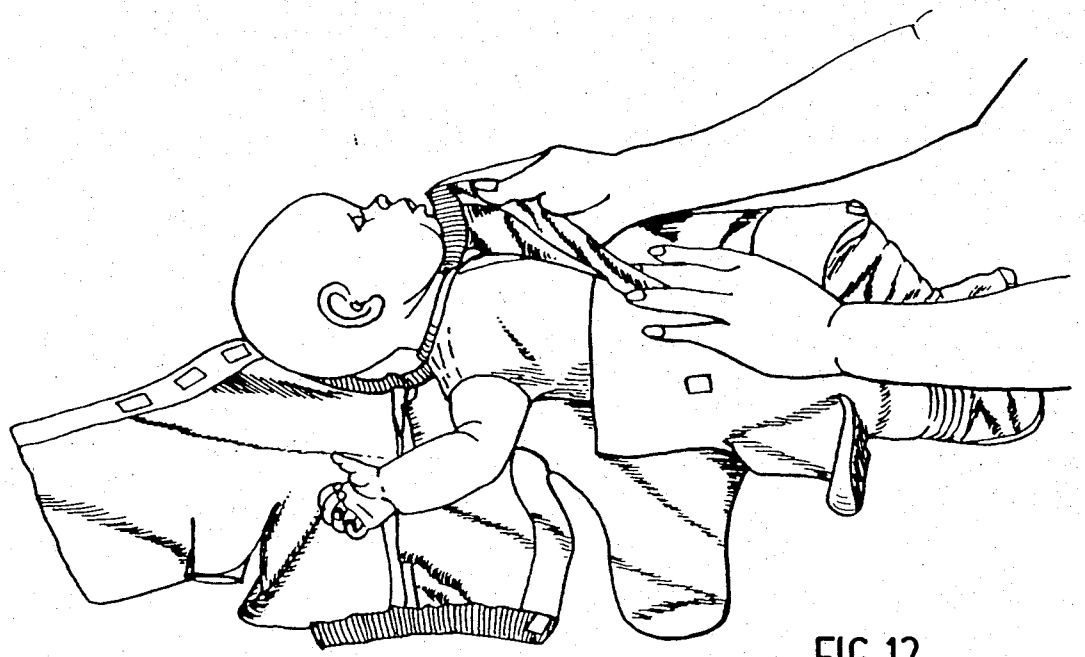
FIG. 12 shows the garment of the invention after dressing the baby.

FIG. 12 represents the garment according to the invention after dressing the baby.

What is claimed is:

1. A garment that can be put on a baby without having to slip the baby's head through a neck opening in said garment or slip the baby's arms through sleeves in said garment; said garment comprising:

a single piece of material which, when laid out flat, is in the shape of a cross; said cross having a vertical axis and a first horizontal axis which intersect at a center of said cross; said cross comprising four quadrilateral forms; two of said forms projecting horizontally and two of said forms extending vertically from said center of said cross; each of said forms having three sides free and a fourth side adjoining the remainder of said piece of material;

a first opening being provided about said center of said cross; said first opening serving as said neck opening when the baby is within said garment;

a slit being provided in one of said vertically-projecting forms; said slit extending vertically from a horizontally-extending free side of said one vertically-projecting form to said first opening; said slit dividing said one vertically-projecting form into two adjacent form portions;

said piece of material being foldable about said first horizontal axis and about the baby to form each of said two horizontally-projecting forms into front and back portions of a sleeve and to form said vertically-projecting forms into front and back portions of said garment;

releasable fastener means being provided along two horizontally-extending free sides of each of said horizontally-projecting forms, on vertically-opposite sides thereof, for fastening said front and back portions of said sleeves to one another along said horizontally-extending free sides to close said sleeves about the arms of the baby when the baby is within said garment; and said garment further comprising: releasable fastener means for fastening said front and back portions of said garment to one another to close said garment at its sides about the baby within said garment; and releasable fastener means for fastening said two adjacent form portions of said one vertically-projecting form to each other along said slit to close said slit with the baby within said garment.

2. The garment of claim 1, wherein said forms are trapezoidal or rectangular in shape.

3. The garment of claim 1, wherein said slit extends along said vertical axis of said cross.

4. The garment of claim 1, wherein said first opening is a substantially circular opening.

5. The garment of claim 1, wherein said material is elastic at least where said horizontally-projecting forms intersect said vertically-projecting forms.

6. The garment of claim 1, wherein releasable fastener means are provided along two vertically-extending free sides of each of said vertically-projecting forms which form said back and front portions of said garment, on horizontally-opposite sides thereof; and on each of said two form portions of said one vertically-projecting form, along said slit; whereby said front and back portions can be fastened to one another to close said garment at its sides and said two form portions can be fastened to each other along said slit to close said slit.

7. The garment of claim 1, wherein another of said vertically-projecting forms is vertically longer than said one vertically-projecting form; said piece of material being adapted to be folded along a second horizontal axis dividing said other vertically-projecting form into two other form portions, said other vertically-projecting from being provided with releasable fastening means along vertically-extending free sides, on horizontally-opposite sides thereof and on vertically opposite sides of said second horizontal axis, for fastening together said two other form portions of said other vertically-projecting form when said other vertically-projecting form is folded about said second horizontal axis and about the baby when the baby is within said garment.

8. The garment of claim 7, wherein a vertically elongated, second opening is provided in said other vertically-projecting form along said vertical axis; and wherein said other vertically-projecting form is provided with releasable fastening means along vertically-extending free sides thereof, along said second opening, on both sides of said second horizontal axis, for fastening together said vertically-extending free sides along said second opening when said other vertically-projecting form is folded about said second horizontal axis and about the baby when the baby is within said garment.

9. The garment of claim 7, wherein said other vertically-projecting form also comprises closed leg ends along said second horizontal axis.

10. The garment of claim 1, wherein said garment still further comprises: a pair of horizontally-projecting parts on horizontally opposite sides of one of said vertically-projecting forms; and releasable fastener means on said pair of parts for fastening together said pair of parts about the baby and about another of said vretically-projecting forms to close said garment at its sides.

11. The garment of claim 1, wherein said material comprises a non-allergenic layer of material.

12. The garment of claim 11, wherein said material comprises a layer of a material which provides warmth to the baby.

13. A garment which can be put on a baby without having to slip the baby's head through a neck opening in said garment or slip the baby's arms through sleeves in said garment but which completely encloses the baby to keep it warm without the need for other garments within said garment; said garment comprising:

a single piece of material which, when laid out flat, is substantially in the shape of a cross, said cross having a vertical axis and a first horizontal axis which intersect at a center of said cross; said cross comprising four substantially quadrilateral forms; two of said forms projecting substantially horizontally and two of said forms extending substantially vertically from said center of said cross; each of said forms having three sides free and a fourth side adjoining the remainder of said piece of material;

a first opening being provided about said center of said cross; said first opening serving as said neck opening when the baby is within said garment;

a slit being provided in one of said vertically-projecting forms; said slit extending vertically from a horizontallyextending free side of said one vertically-projecting to said first opening; said slit dividing said one vertically-projecting form into two adjacent form portions;

said piece of material being foldable about said first horizontal axis and about the baby to form each of said two horizontally-projecting forms into front and back portions of a sleeve and to form said vertically-projecting forms into front and back portions of said garment;

releasable fastener means being provided along two horizontally-extending free sides of each of said horizontallyprojecting forms, on vertically-opposite sides thereof, for fastening said front and back portions of said sleeves to one another along said horizontally-extending free sides to close said sleeves about the arms of the baby when the baby is within said garment;

said garment also comprising: releasable fastener means for fastening said front and back portions of said garment to one another to close said garment at its sides about the baby within said garment; and releasable fastener means for fastening said two adjacent form portions of said one vertically-projecting form to each other along said slit to close said slit with the baby within said garment; and said garment further comprising: a convex shape where one of the horizontally-extending free sides of each horizontally-projecting form intersects one of the vertically-extending free sides of one of the vertically-projecting forms; each of said convex shapes defining an enlargement of said material which can be introduced under an armpit of the baby to close further each of said sleeves about the baby.

14. The garment of claim 13, wherein said enlargement is rounded.

15. The garment of claim 13, wherein said forms are trapezoidal or rectangular in shape.

16. The garment of claim 13, wherein said slit extends along said vertical axis of said cross.

17. The garment of claim 13, wherein said first opening is a substantially circular opening.

18. The garment of claim 13, wherein said material is elastic at least where said horizontally-projecting forms intersect said vertically-projecting forms.

19. The garment of claim 13, wherein releasable fastener means are provided along two vertically-extending free sides of each of said vertically-projecting forms which form said back and front portions of said garment, on horizontally-opposite sides thereof; and on each of said two form portions of said one vertically-projecting form, along said slit; whereby said front and back portions can be fastened to one another to close said garment at its sides and said two form portions can be fastened to each other together along said slit to close said slit.

20. The garment of claim 13, wherein another of said vertically-projecting forms is vertically longer than said one vertically-projecting form; said piece of material being adapted to be folded along a second horizontal axis dividing said other vertically-projecting form into two other form portions; said other vertically-projecting form being provided with releasable fastening means along vertically-extending free sides, on horizontally-opposite sides thereof and on vertically opposite sides of said second horizontal axis, for fastening together said two other form portions of said other vertically-projecting form when said other vertically-projecting form is folded about said second horizontal axis and about the baby when said baby is within the garment.

21. The garment of claim 20, wherein said other vertically-projecting form also comprises closed leg ends along said second horizontal axis.

22. The garment of claim 20, wherein a vertically elongated, second opening is provided in said other vertically-projecting form along said vertical axis; and wherein said other vertically-projecting form is provided with releasable fastening means along vertically-extending free sides thereof, along said second opening, on both sides of said second horizontal axis, for fastening together said vertically-extending free sides along said opening when said other verticallyprojecting form is folded about said second horizontal axis and about the baby when the baby is within said garment.

23. The garment of claim 13, wherein said garment still further comprises a pair of horizontally-projecting parts on horizontally opposite sides of one of said vertically-projecting forms; and releasable fastener means on said pair of parts for fastenining together said pair of parts about the baby and about another of said vertically-projecting forms to close said garment at its sides.

24. The garment of claim 13, wherein said material comprises a layer of a material which provides warmth to said baby.

25. The garment of claim 24, wherein said material comprises a layer of a non-allergenic material.

* * * * *

UNITED STATES PATENT AND TRADEMARK OFFICE

CERTIFICATE OF CORRECTION

PATENT NO. : 4,726,076

DATED : Feb. 23, 1988

INVENTOR(S) : DOUEZ, Francoise

It is certified that error appears in the above-identified patent and that said Letters Patent is hereby corrected as shown below:

Please add the following to the upper left hand portion of the cover page:

[30] Foreign Application Priority Data
June 26, 1985 France.....85 09738

Signed and Sealed this

Sixteenth Day of August, 1988

*Attest:*

*Attesting Officer*

DONALD J. QUIGG

*Commissioner of Patents and Trademarks*